US009822684B2

(12) United States Patent
Boriga et al.

(10) Patent No.: US 9,822,684 B2
(45) Date of Patent: Nov. 21, 2017

(54) EXHAUST GAS DUCT SYSTEM FOR AN INTERNAL COMBUSTION ENGINE

(71) Applicant: Eberspächer Exhaust Technology GmbH & Co. KG, Neunkirchen (DE)

(72) Inventors: Remus Boriga, Wernau (DE); Michael Marquardt-Stammberger, Münsingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 15/050,935

(22) Filed: Feb. 23, 2016

(65) Prior Publication Data

US 2016/0245140 A1 Aug. 25, 2016

(30) Foreign Application Priority Data

Feb. 24, 2015 (DE) ..... 10 2015 102 611

(51) Int. Cl.

| | |
|---|---|
| ***F01N 3/02*** | (2006.01) |
| ***F01N 3/038*** | (2006.01) |
| ***F01N 13/18*** | (2010.01) |
| ***F01N 1/00*** | (2006.01) |
| ***F01N 13/00*** | (2010.01) |

(52) U.S. Cl.

CPC ..... *F01N 3/038* (2013.01); *F01N 1/003* (2013.01); *F01N 1/006* (2013.01); *F01N 13/007* (2013.01); *F01N 13/1888* (2013.01); *F01N 13/1894* (2013.01); *F01N 2240/22* (2013.01); *F01N 2470/18* (2013.01); *F01N 2490/08* (2013.01); *F01N 2490/15* (2013.01); *F01N 2570/22* (2013.01)

(58) Field of Classification Search

CPC .... F01N 3/038; F01N 13/007; F01N 13/1888; F01N 13/1894; F01N 1/003; F01N 1/006

USPC ..... 60/309

See application file for complete search history.

(56) References Cited

U.S. PATENT DOCUMENTS

| | | | |
|---|---|---|---|
| 2004/0079079 | A1 | 4/2004 | Martin et al. |
| 2014/0054101 | A1 | 2/2014 | Zhang et al. |
| 2014/0161677 | A1 | 6/2014 | Latham et al. |
| 2014/0166392 | A1 | 6/2014 | Kye et al. |

FOREIGN PATENT DOCUMENTS

| | | | |
|---|---|---|---|
| DE | 199 12 330 | A1 | 9/2000 |
| DE | 11 2009 000 763 | T5 | 3/2011 |
| DE | 11 2006 000 693 | B4 | 9/2011 |

(Continued)

OTHER PUBLICATIONS

English translation of German Patent Application Publication No. DE 102012206871 A1 (Oct. 2013).*

*Primary Examiner* — Jason Shanske

(74) *Attorney, Agent, or Firm* — McGlew and Tuttle, P.C.

(57) ABSTRACT

An exhaust gas duct system for an internal combustion engine includes an upstream, first exhaust gas pipe area (30), a downstream, second exhaust gas pipe area (34) adjoining the first exhaust gas pipe area (30) in a transition area (38) in an exhaust gas flow direction (G), and a liquid drain channel area (60) in the transition area. The drain channel area is open from the exhaust gas flow volume (78) in the first exhaust gas pipe area (30) or/and in the second exhaust gas pipe area (34) to a liquid collection volume (80).

18 Claims, 3 Drawing Sheets

(56) References Cited

FOREIGN PATENT DOCUMENTS

| | | | |
|---|---|---|---|
| DE | 10 2012 206871 | A1 | 10/2013 |
| DE | 11 2006 003 385 | B4 | 9/2015 |
| EP | 1 039 105 | A2 | 9/2000 |

* cited by examiner

EXHAUST GAS DUCT SYSTEM FOR AN INTERNAL COMBUSTION ENGINE

CROSS REFERENCE TO RELATED APPLICATIONS

This application claims the benefit of priority under 35 U.S.C. §119 of German Patent Application DE 10 2015 102 611.2 filed Feb. 24, 2015, the entire contents of which are incorporated herein by reference.

FIELD OF THE INVENTION

The present invention pertains to an exhaust gas duct system for an internal combustion engine, which may be provided, for example, in a passenger car, a truck or a motorcycle.

BACKGROUND OF THE INVENTION

One or more probes, which protrude into the exhaust gas flow volume of the exhaust gas duct system for interaction with the exhaust gases, are frequently provided in exhaust gas duct systems removing combustion waste gases from an internal combustion engine for detecting the composition of the combustion waste gases, for example, in an upstream area of said exhaust gas duct systems. The exhaust gas duct system is, in general, open towards the outside in its downstream end area, so that it is possible, in principle, that liquid, e.g., water, will enter this downstream end area of the exhaust gas duct system. If the water reaches the area of the probes, the latter may be damaged. Since the output signals of such probes, which signals represent the exhaust gas composition, are also used to actuate, for example, an internal combustion engine in order to make it possible to reach the lowest possible pollutant emission, a loss of function or malfunction in the area of the probes may lead to a corresponding impairment in the operation of an internal combustion engine or other system areas of a vehicle.

SUMMARY OF THE INVENTION

An object of the present invention is to provide an exhaust gas duct system for an internal combustion engine, especially of a vehicle, which system prevents the entry of liquid while having a simple and compact design.

This object is accomplished according to the present invention by an exhaust gas duct system for an internal combustion engine, comprising an upstream, first exhaust gas pipe area (first exhaust gas pipe portion), a downstream, second exhaust gas pipe area second exhaust gas pipe portion) adjoining the first exhaust gas pipe area in an exhaust gas flow direction, and a liquid drain channel area in the transition area, which said liquid drain channel area is open from an exhaust gas flow volume in the first exhaust gas pipe area or/and in the second exhaust gas pipe area.

It is ensured in the exhaust gas duct system designed according to the present invention that in the area in which two exhaust gas pipe areas adjoin each other, liquid entering from the downstream end area of the exhaust gas duct system is drained off from the exhaust gas flow volume via the liquid drain channel and is taken up in a liquid collection volume. The provision of the liquid drain channel area where two exhaust gas pipe areas adjoin each other can be embodied in a simple manner with a compact mode of construction and it eliminates the need for milling special channel arrangements in individual components of an exhaust gas duct system.

Provisions may be made, for example, for the liquid drain channel area to comprise an intermediate space formed between the first exhaust gas pipe area and the second exhaust gas pipe area. Such an intermediate space may be prepared in a simple manner, for example, by means of a jump in the transverse dimension of the exhaust gas pipe areas adjoining each other and it does not require any additional constructive measures.

To make it possible to connect the two exhaust gas pipe areas to one another, on the one hand, and to also make it possible to produce the intermediate space for the outlet of the liquid, on the other hand, it is proposed that a downstream end area of the first exhaust gas pipe area mesh with an upstream end area of the second exhaust gas pipe area in the transition area and that the intermediate space between an outer surface of the first exhaust gas pipe area and an inner surface of the second exhaust gas pipe area be formed at least in a circumferential area.

The jump in the transverse dimension in the transition area between the two exhaust gas pipe areas for generating the intermediate space for the liquid rain channel area can be achieved in a simple manner by the second exhaust gas pipe area being expanded in the upstream direction towards the upstream end area thereof in at least one direction at right angles to the exhaust gas flow direction. This expansion can be provided, for example, in relation to a circular basic cross-sectional geometry by the second exhaust gas pipe area having a flattened circular circumferential contour, preferably an oval or elliptical contour, in its upstream end area.

To provide the liquid collection volume in the exhaust gas duct system designed according to the present invention in association with the transition area, it is proposed that the transition area be arranged in a housing providing the liquid collection volume.

To provide a stable assembly unit, provisions are made for the housing to have an inlet opening, the first exhaust gas pipe area being led through the inlet opening into the interior of the housing, or/and an outlet opening, the second exhaust gas pipe area being led out of the interior of the housing through the outlet opening. Provisions may be made now, in particular, for the first exhaust gas pipe area to comprise a first pipe section, which extends in the interior of the housing, provides the downstream end area of the first exhaust gas pipe area and is permanently connected to the housing in the area of the inlet opening, or/and for the second exhaust gas pipe area to comprise a second pipe section, which extends in the interior of the housing, provides the upstream end area of the second exhaust gas pipe area and is permanently connected to the housing in the area of the outlet opening.

The housing may be designed with the first pipe section and with the second pipe section as an assembly unit in the manner of an exhaust muffler or rear muffler. To bring about the feeding and removal of exhaust gases to and from this assembly unit in a simple manner, it is proposed that the first exhaust gas pipe area comprise a third pipe section connected permanently to the first pipe section preferably in the area of the inlet opening, or/and that the second exhaust gas pipe area comprise a fourth pipe section connected permanently to the second pipe section preferably in the area of the outlet opening.

To provide with the housing not only the functionality of a liquid collection volume, but to also make it possible to use this especially for muffling, it is proposed that at least one plate-like (plate shaped) sound absorption element be arranged in the interior of the housing.

The arrangement may be such that at least one sound absorption element surrounds the upstream end area of the second exhaust gas pipe area or/and is permanently connected to the upstream end area of the second exhaust gas pipe area or/and is permanently connected to the housing in its outer circumferential area or/and comprises a first sound absorption opening arrangement. In particular, the at least one sound absorption element may divide the interior space of the housing into two areas, which are in connection with one another via the first sound absorption opening arrangement, so that a large inner volume area of the housing is nevertheless available as a liquid collection volume.

The sound absorption functionality can be further improved in the exhaust gas duct system according to the present invention by the second exhaust gas pipe area having in its area extending in the interior of the housing a second sound absorption opening arrangement downstream of the transition area.

To make the design as simple as possible in the area of the housing as well, but to create the possibility of leading the two exhaust gas pipe areas into this housing or to couple two exhaust pipe areas to this housing, it is proposed that the housing comprise a first housing shell providing at least one part and preferably the entire inlet opening and at least one part of the outlet opening and a part of the inlet opening not provided by the first housing shell, and a part of the outlet opening, which part is not provided by the first housing shell and is permanently connected to the first housing shell.

The present invention will be described below in detail with reference to the attached figures. The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
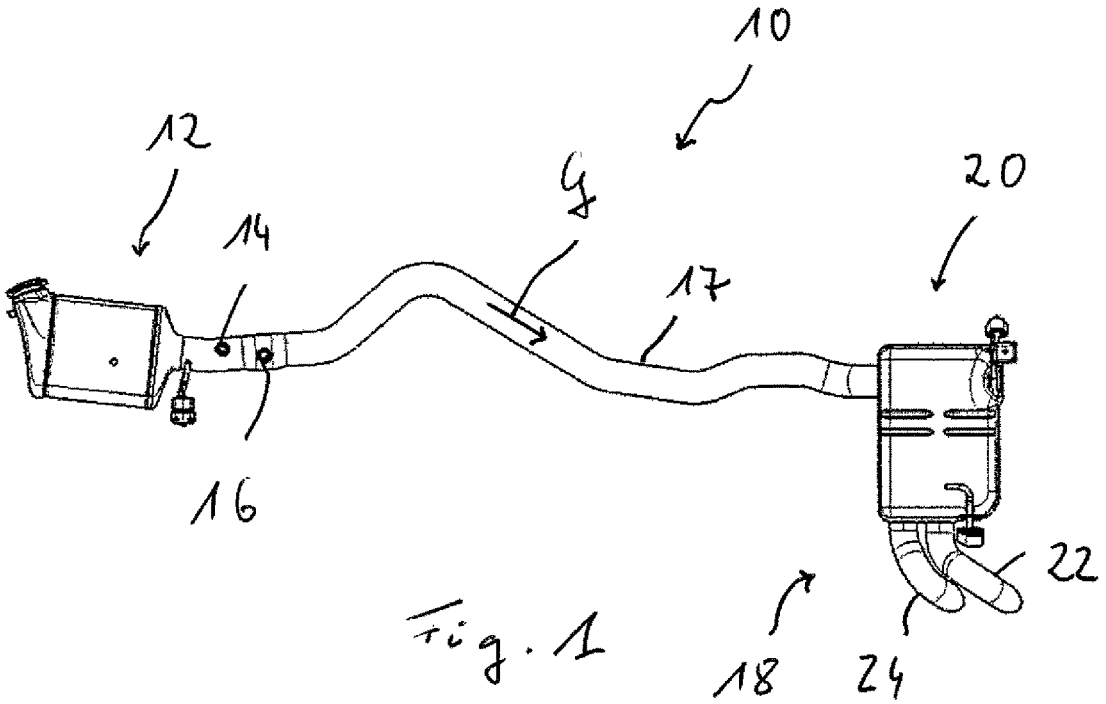
FIG. 1 is an exhaust gas duct system that can be used in a motor vehicle.

Referring to the drawings, FIG. 1 shows an exhaust gas duct system 10 for an internal combustion engine, for example, in a passenger car. The exhaust gas duct system 10 is designed in its upstream end area 12 to receive combustion waste gases from an internal combustion engine. Probes 14, 16, which protrude into the gas flow flowing in the exhaust gas duct system 10 and thus furnish information on the composition of the combustion waste gases, are provided in the exhaust gas duct system 10 in this upstream end area 12. This information may be used, for example, to actuate an internal combustion engine in order to minimize the pollutant emission. The combustion waste gases flow in a gas flow direction G through the exhaust pipe 17 from the upstream end area 12 to a downstream end area 18 of the exhaust gas duct system 10. The combustion waste gases leave the exhaust gas duct system 10 in the downstream end area 18 via two tail pipes 22, 24 leading away from an exhaust muffler or rear muffler 20 in the exemplary embodiment being shown.

Figure 4:
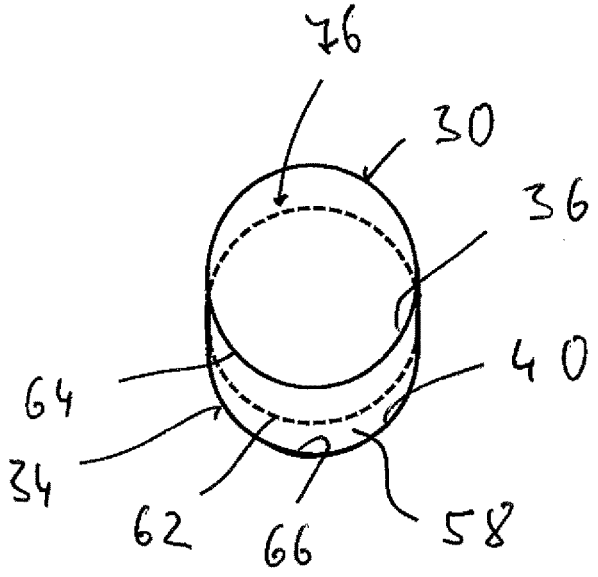
FIG. 4 is a schematic view of a transition area between two exhaust gas pipe areas as viewed in the direction of the exhaust gas flow.

Technical measures, by which it is ensured that liquid, e.g., water, which enters the exhaust gas duct system 10 in the area of the downstream end area 18, is prevented from reaching the upstream end area 12 and especially the probes 14, 16 positioned there, will be described below with reference to FIGS. 2 through 4.

Figure 2:
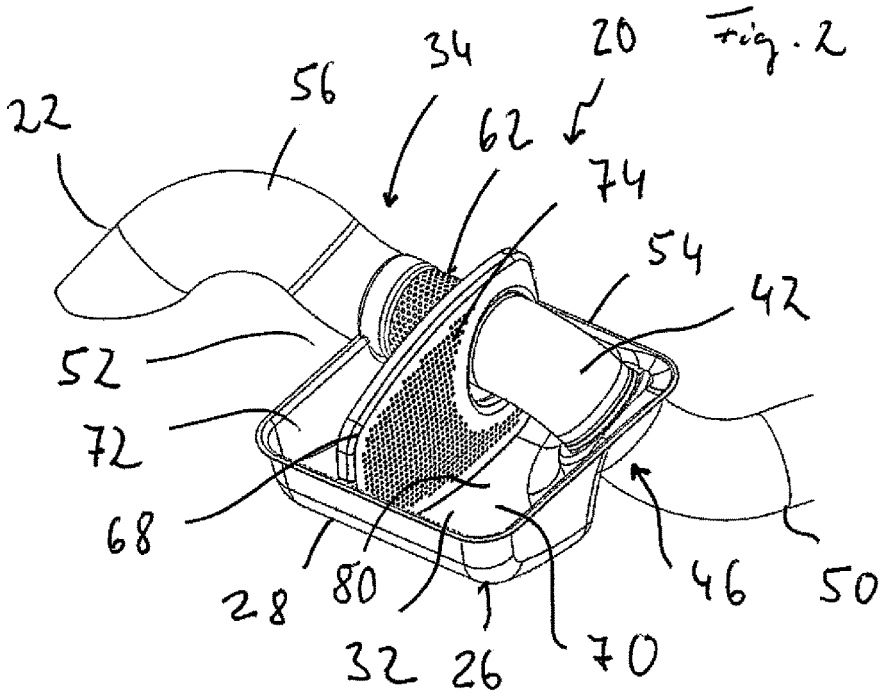
FIG. 2 is a downstream end area of an exhaust gas duct system with a housing, which is shown only partially and provides a liquid collection volume.
Figure 3:
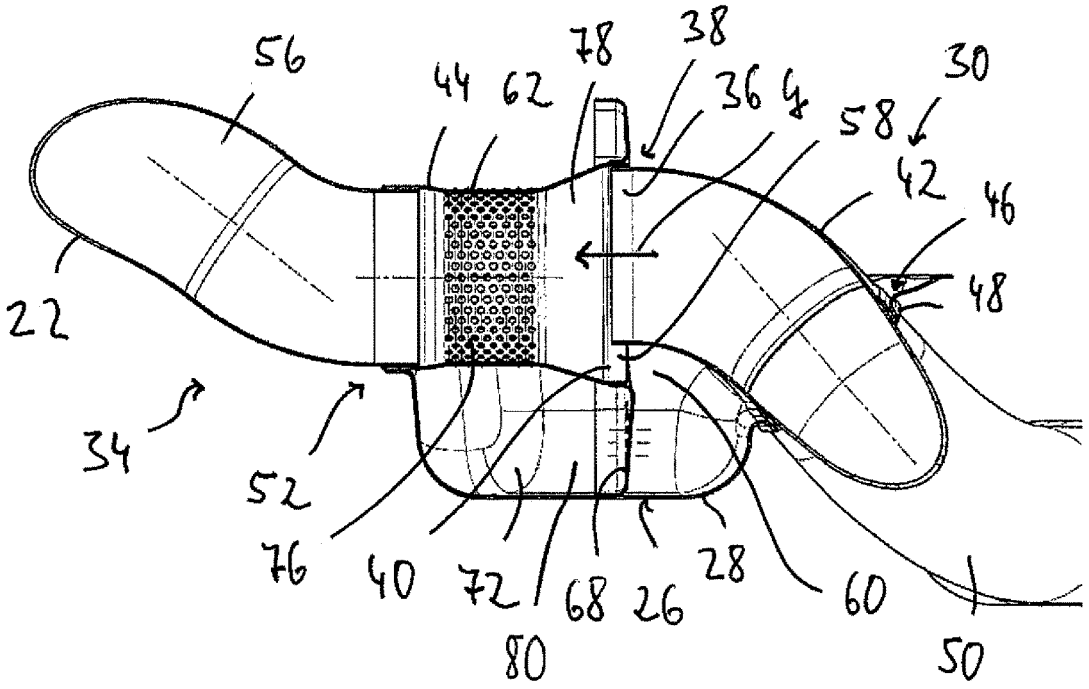
FIG. 3 is the area of an exhaust gas duct system, partially cut away, which area is shown in FIG. 2.

FIGS. 2 and 3 show the downstream end area 18 of the exhaust gas duct system 20 with the exhaust muffler 20 positioned there. The exhaust muffler 20 comprises a housing generally designated by 26, of which only a lower housing shell 28 is shown in FIGS. 2 and 3.

The exhaust gas duct system 10 comprises an upstream, first exhaust gas pipe area 30, which leads into the interior 32 of the housing 26. Further, the exhaust gas duct system 10 comprises a downstream, second exhaust gas pipe area 34, which leads out of the interior 32 of the housing 26 and is provided with a single tail pipe 22 in the example shown in FIGS. 2 and 3. As this is shown in FIG. 3, the first exhaust gas pipe area 30 and the second exhaust gas pipe area 34 are in flow connection, so that the exhaust gases flowing through the exhaust gas duct system 10 can flow in the exhaust gas flow direction G from the first exhaust gas pipe area 30 into the second exhaust gas pipe area 34.

It can be clearly seen in FIG. 3 that a downstream end area 36 of the first exhaust gas pipe area 30 protrudes into an upstream end area 40 of the second exhaust gas pipe area 34 in a transition area generally designated by 38. For example, the first exhaust gas pipe area 30 and the second exhaust gas pipe area 34 may be formed in these end areas 38, 40 with an essentially cylindrical shape.

The first exhaust gas pipe area 30 comprises a first pipe section 42 extending essentially in the interior 32 of the housing 26 and providing the downstream end area 36. The second exhaust gas pipe area 34 comprises a second pipe section 44, which likewise extends essentially in the interior 32 of the housing 26 and which provides the upstream end area 40. In its end located at a distance from the downstream end area 36, the first pipe section 42 is inserted into an inlet opening 46 formed in the housing shell 28 and is permanently connected in this area in a fluid-tight manner, for example, to an essentially cylindrical section 48 of the housing shell 28, which said essentially cylindrical section 48 surrounds the inlet opening 46, for example, by welding. A third pipe section 50, which can be considered to be part of the first exhaust gas pipe area 30, may be inserted, for example, in the area of the inlet opening 46, into the end of the first pipe section 42, which said end of the first pipe section 42 is positioned there, and may be connected thereto permanently and in a fluid-tight manner, for example, by welding.

In the areas of an outlet opening 52 formed in the housing 26, the second pipe section 44 is permanently connected to the housing, for example, by welding, in its end located facing away from the upstream end area 40. FIGS. 2 and 3 show clearly that only a part of this outlet opening 52 is formed in the lower housing shell 28 shown in the figures. The remaining part of the outlet opening is formed in the upper housing shell, which is to be placed on the lower housing shell 28. An edge area, which surrounds these two housing shells and is, for example, cylindrical and to which the second pipe section 44 may be connected permanently and in a fluid-tight manner, for example, by welding, may be formed by these two housing shells here as well. The two housing shells may be connected to one another permanently and in a fluid-tight manner, for example, by welding, in the area of respective flange-like edge areas 54 formed on same, the housing shells. A fourth pipe section 56, which is inserted, for example, in the area of the outlet opening 52 into the end of the second pipe section 44, which end is positioned there, is permanently connected to the second pipe section 44, for example, by welding, and provides the tail pipe 22 in the example being shown, while the first pipe section 42 provides, for example, an inlet pipe and the second pipe section 44 provides, for example, an outlet pipe of the exhaust muffler 20.

Figure 5:
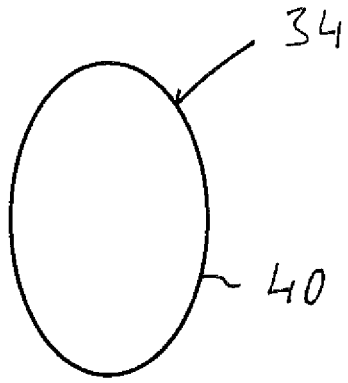
FIGS. 5 and 6 are schematic views of contours of the second pipe area.
Figure 6:
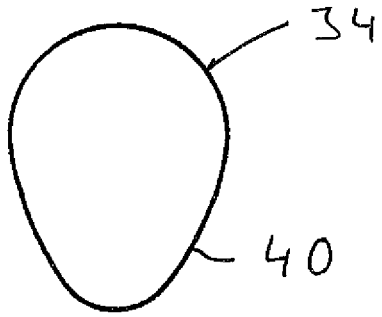

The first pipe section 42 and the second pipe section 44 are dimensioned or shaped in their end areas 36, 40 in the area of the transition area 38 such that an intermediate space 58 is obtained, which is positioned essentially in a lower area in the installed state in a vehicle and which forms essentially a liquid drain channel 60 leading to the interior 32 of the housing 26. This intermediate space 58 may be provided, for example, by the first pipe section 42 being provided with an essentially circular cross-sectional contour in its downstream end area 36. Starting from a central area 62, which is likewise designed, for example, with a circular, essentially cylindrical cross-sectional geometry, the second pipe section 44 may be expanded in a funnel-like manner and then flattened, so that a flattened round, for example, approximately oval or elliptical cross-sectional contour (See FIGS. 5 and 6) is obtained in the upstream end area 40 of the second pipe section 44, and this cross-sectional contour is expanded in at least one direction at right angles to the gas flow direction G compared to the cross-sectional contour of the downstream end area 36 of the first pipe section 42. The intermediate space 58, which has an approximately sickle-shaped design and can be clearly seen in the schematic view shown in FIG. 4, is thus obtained in a circumferential area between an outer surface 64 of the first pipe section 42 in the downstream end area 36 and an inner surface 66 of the second pipe section 44 in the upstream end area 40. Where the two end areas 36, 40 are in contact with one another, i.e., in the upper area of the view in FIG. 4, the two pipe sections 42, 44 may be permanently connected to one another, for example, by welding or/and by press fit.

The exhaust muffler 20 comprises, further, a plate-like (plate shaped) sound absorption element 68, which surrounds the upstream end area 40, for example, in the transition area 38, is permanently connected in this area to the second pipe section 44, and may be fixed with its outer circumferential area on an inner surface of the housing 26. The sound absorption element 68 divides the interior 32 of the housing 26 into two space areas 70, 72. Since a first sound absorption opening arrangement 74 comprising a plurality of holes or openings is formed in the sound absorption element 68, the two space areas 70, 72 are, in principle, nevertheless in connection with one another. A second sound absorption opening arrangement 76 is formed in the central area 62 of the second pipe section 44, so that the exhaust gas flow volume 78 formed in the area of the exhaust muffler 20 or in the area of the first exhaust gas pipe area 30 or of the second exhaust gas pipe area 34 is, in principle, open towards the interior 32 of the housing 26. The two sound absorption opening arrangements 74, 76 of the exhaust muffler 20 contribute to the sound absorption primarily by sound reflection.

By providing the intermediate space 58 providing essentially the liquid drain channel 60 in the transition area 38 between the two exhaust pipe areas 30, 34, the possibility is created for liquid, for example, water, penetrating via the tail pipe 22 or the second exhaust gas pipe area 34 to enter a liquid collection volume 80 provided especially in the area of the lower housing shell 28 before entering the first exhaust gas pipe area 30. Part of the water entering via the tail pipe 22 may also enter the liquid collection volume 80 via the second sound absorption opening arrangement 76, especially when the inflow velocity is comparatively low. Especially when water gushes in, as it may be the case, for example, when driving through pools or streams of liquid or the like, the water will, however, move essentially completely beyond the second sound absorption opening arrangement 76 and may reach the liquid collection volume 80 via the intermediate space 58. It is thus guaranteed that the exhaust gas duct system 10 or a vehicle equipped therewith will have the generally required fordability (water exposure), with which it is guaranteed that the entry of water into the exhaust gas duct system 10 especially up to the upstream area 12, where the probes 14, 16 are positioned, is also prevented for a predetermined time period with the internal combustion engine shut off. A comparatively large quantity of liquid or water can be taken up by the liquid collection volume 80 provided in the interior of the housing 26. This liquid is gradually evaporated during the combustion operation by the comparatively high temperature that the different components of the exhaust gas duct system 10 will have, and the exhaust gas flow flowing in the exhaust gas flow direction G develops a suction pump effect for evaporating liquid and draws off the liquid vapor from the liquid collection volume 80. Drainage openings that can be opened manually or in an automated manner may also be provided, if necessary, in the area of the housing 26 in order to drain larger quantities of liquid collected therein.

Due to the possibility of draining liquid entering an exhaust gas duct system through a liquid drain channel area in the transition area between two exhaust pipe areas and of storing it in a liquid collection volume, which possibility is provided according to the present invention, a simple possibility, which can nevertheless be embodied in a compact design, is created for protecting further system areas of an exhaust gas duct system from entering liquid. The design according to the present invention of an exhaust gas duct system is therefore suitable not only for larger vehicles, e.g., trucks or utility vehicles, but may also be used especially in passenger cars and in motorcycles. The design according to the present invention of the exhaust gas duct system does not compromise the exhaust gas flow and thus it does not lead to a higher back pressure and hence to a reduction of the output of a drive unit coupled with this exhaust gas duct system.

It should finally be noted that the exhaust gas duct system according to the present invention could, of course, be designed differently especially in the area of the components that provide the liquid drain channel or interact with same. Thus, additional measures contributing to sound insulation may, of course, be taken in the interior of the housing, which also provides the liquid collection volume. Such a housing providing the liquid collection volume could also be designed exclusively for this purpose and without measures taken for sound insulation or without positioning components used for sound insulation in the interior thereof. As this is also shown in FIG. 1, the second exhaust gas pipe area may, of course, also be designed such that more than one tail pipe leads out of the housing.

Further, the exhaust gas duct system according to the present invention could also be designed essentially only as an exhaust muffler, i.e., for example, comprise the housing with the first pipe section and with the second pipe section of the two exhaust gas pipe areas, and additional pipe sections may then be attached to said pipe sections as separate assembly units.

While specific embodiments of the invention have been shown and described in detail to illustrate the application of the principles of the invention, it will be understood that the invention may be embodied otherwise without departing from such principles.

What is claimed is:

1. An exhaust gas duct system for an internal combustion engine, the exhaust gas duct system comprising:

an upstream, first exhaust gas pipe area;

a downstream, second exhaust gas pipe area adjoining the first exhaust gas pipe area in a transition area in an exhaust gas flow direction; and a liquid drain channel area in the transition area, which channel area is open from an exhaust gas flow volume in the first exhaust gas pipe area or is open from an exhaust gas flow volume in the second exhaust gas pipe area or is open from both the exhaust gas flow volume in the first exhaust gas pipe area and the exhaust gas flow volume in the second exhaust gas pipe area to a liquid collection volume, the liquid drain channel area comprising an intermediate space formed between the first exhaust gas pipe area and the second exhaust gas pipe area, wherein a downstream end area of the first exhaust gas pipe area protrudes into an upstream end area of the second exhaust gas pipe area in the transition area such that the first exhaust gas pipe area and the second exhaust gas pipe area are in contact with one another in a first circumferential area in the transition area, the intermediate space having a sickle-shaped design between an outer surface of the first exhaust gas pipe area and an inner surface of the second exhaust gas pipe area being formed in a second circumferential area, wherein the first exhaust gas pipe area and the second exhaust gas pipe area are not in contact with one another in the second circumferential area in the transition area.

2. An exhaust gas duct system in accordance with claim 1, wherein the second exhaust gas pipe area is expanded upstream towards a second exhaust gas pipe upstream end area in at least one direction which is at right angles to the exhaust gas flow direction.

3. An exhaust gas duct system in accordance with claim 2, wherein the second exhaust gas pipe area has a flattened, round circumferential contour in the second exhaust gas pipe upstream end area.

4. An exhaust gas duct system in accordance with claim 3, wherein the flattened, round circumferential contour is an oval or elliptical contour.

5. An exhaust gas duct system in accordance with claim 1, wherein the transition area is arranged in a housing providing the liquid collection volume.

6. An exhaust gas duct system in accordance with claim 4, wherein:

the housing comprises an inlet opening, wherein the first exhaust gas pipe area is led through the inlet opening into the interior of the housing; or the housing comprises an outlet opening, wherein the second exhaust gas pipe area is led through the outlet opening from the interior of the housing; or the housing comprises an inlet opening, wherein the first exhaust gas pipe area is led through the inlet opening into the interior of the housing and the housing comprises an outlet opening, wherein the second exhaust gas pipe area is led through the outlet opening from the interior of the housing.

7. An exhaust gas duct system in accordance with claim 6, wherein:

the first exhaust gas pipe area comprises a first pipe section, which extends in the interior of the housing, provides the downstream end area of the first exhaust gas pipe area and is permanently connected to the housing in an area of the inlet opening; or the second exhaust gas pipe area comprises a second pipe section, which extends in the interior of the housing, provides the upstream end area of the second exhaust gas pipe area and is permanently connected to the housing in the area of the outlet opening; or the first exhaust gas pipe area comprises a first pipe section, which extends in the interior of the housing, provides the downstream end area of the first exhaust gas pipe area and is permanently connected to the housing in an area of the inlet opening and the second exhaust gas pipe area comprises a second pipe section, which extends in the interior of the housing, provides the upstream end area of the second exhaust gas pipe area and is permanently connected to the housing in the area of the outlet opening.

8. An exhaust gas duct system in accordance with claim 7, wherein:

the first exhaust gas pipe area comprises a third pipe section, which is permanently connected to the first pipe section, in the area of the inlet opening; or the second exhaust gas pipe area comprises a fourth pipe section permanently connected to the second pipe section, in the area of the outlet opening; or the first exhaust gas pipe area comprises a third pipe section, which is permanently connected to the first pipe section, in the area of the inlet opening and the second exhaust gas pipe area comprises a fourth pipe section permanently connected to the second pipe section, in the area of the outlet opening.

9. An exhaust gas duct system in accordance with claim 5, further comprising at least one plate shaped sound absorption element arranged in an interior of the housing.

10. An exhaust gas duct system in accordance with claim 9, wherein:

the at least one sound absorption element surrounds the upstream end area of the second exhaust gas pipe area; or the at least one sound absorption element is permanently connected to the upstream end area of the second exhaust gas pipe area; or the at least one sound absorption element is permanently connected to the housing in a sound absorption element outer circumferential area; or the sound absorption element comprises a first sound absorption opening arrangement or any combination of:

the at least one sound absorption element surrounds the upstream end area of the second exhaust gas pipe area; and the at least one sound absorption element is permanently connected to the upstream end area of the second exhaust gas pipe area; and the at least one sound absorption element is permanently connected to the housing in a sound absorption element outer circumferential area; and the sound absorption element comprises a first sound absorption opening arrangement.

11. An exhaust gas duct system in accordance with claim 5, wherein the second exhaust gas pipe area has a second sound absorption opening arrangement downstream of the transition area in a second exhaust gas pipe area extending in the interior of the housing.

12. An exhaust gas duct system in accordance with claim 6, wherein the housing comprises:

a first housing shell, which provides at least a part of the inlet opening and at least a part of the outlet opening; and a second housing shell, which provides a part of the inlet opening, which part is not provided by the first housing shell and provides a part of the outlet opening, which part is not provided by the first housing shell, said second housing shell being permanently connected to the first housing shell.

13. An internal combustion engine exhaust gas duct system comprising:

a first exhaust gas pipe portion;

a second exhaust gas pipe portion fluidically connected to the first exhaust gas pipe portion in a transition area in an exhaust gas flow direction;

a liquid drain channel, in the transition area, in fluid communication with an exhaust gas flow volume of the first exhaust gas pipe portion and the second exhaust gas pipe portion; and a liquid collection volume, whereby liquid entering from the downstream end area of the exhaust gas duct system is drained off from the exhaust gas flow volume via the liquid drain channel to the liquid collection volume, the liquid drain channel comprising an intermediate space defined by the first exhaust gas pipe portion and the second exhaust gas pipe portion, wherein a downstream end area of the first exhaust gas pipe portion protrudes into an upstream end area of the second exhaust gas pipe portion in the transition area such that the first exhaust gas pipe portion and the second exhaust gas pipe portion are in contact with one another in a first circumferential area in the transition area, the intermediate space having a contour in a form of a sickle, the intermediate space being defined in a second circumferential area of the transition area between an outer surface of the first exhaust gas pipe portion and an inner surface of the second exhaust gas pipe portion, wherein the first exhaust gas pipe portion and the second exhaust gas portion area are not in contact with one another in the second circumferential area in the transition area.

14. An exhaust gas duct system in accordance with claim 13, further comprising a housing defining the liquid collection volume, the transition area being arranged in the housing, wherein:

the housing comprises an inlet opening, wherein the first exhaust gas pipe portion is led through the inlet opening into the interior of the housing wherein the first exhaust gas pipe portion comprises a first pipe section, which extends in the interior of the housing, provides the downstream end area of the first exhaust gas pipe portion and is permanently connected to the housing in an area of the inlet opening; and the housing comprises an outlet opening, wherein the second exhaust gas pipe portion is led through the outlet opening from the interior of the housing, wherein the second exhaust gas pipe portion comprises a second pipe section, which extends in the interior of the housing, provides the upstream end area of the second exhaust gas pipe portion and is permanently connected to the housing in the area of the outlet opening.

15. An exhaust gas duct system in accordance with claim 14, further comprising a sound absorption element in the housing.

16. An exhaust gas duct system in accordance with claim 14, wherein the housing comprises:

a first housing shell, which provides at least a part of the inlet opening and at least a part of the outlet opening; and a second housing shell provides a part of the inlet opening, which part is not provided by the first housing shell and provides a part of the outlet opening, which part is not provided by the first housing shell, said second housing shell being permanently connected to the first housing shell.

17. An internal combustion engine exhaust gas duct system comprising:

a first exhaust gas pipe portion comprising a first exhaust gas pipe first outer portion and a first exhaust gas pipe second outer portion;

a second exhaust gas pipe portion fluidically connected to the first exhaust gas pipe portion in a transition area in an exhaust gas flow direction, the second exhaust gas pipe portion comprising a second exhaust gas pipe first inner portion and a second exhaust gas pipe second inner portion, the transition area comprising a first circumferential transition area and a second circumferential transition area;

a liquid drain channel, in the transition area, in fluid communication with an exhaust gas flow volume of the first exhaust gas pipe portion and the second exhaust gas pipe portion; and a liquid collection volume, whereby liquid entering from the downstream end area of the exhaust gas duct system is drained off from the exhaust gas flow volume via the liquid drain channel to the liquid collection volume, the liquid drain channel comprising an intermediate space defined between the first exhaust gas pipe portion and the second exhaust gas pipe portion, wherein a downstream end area of the first exhaust gas pipe portion protrudes into an upstream end area of the second exhaust gas pipe portion in the transition area such that the first exhaust gas pipe first outer portion is in direct contact with the second exhaust gas pipe first inner portion in the first circumferential area of the transition area, the first exhaust gas pipe second outer portion and the second exhaust gas pipe second inner portion defining the intermediate space in the second circumferential area of the transition area, wherein the first exhaust gas pipe second outer portion is located at a spaced location from the second exhaust gas pipe second inner portion in the second circumferential area of the transition area, the first exhaust gas pipe second outer portion comprises a first exhaust gas pipe first end portion and a second exhaust gas pipe second end portion, the second exhaust gas pipe second inner portion comprising a second exhaust gas pipe first end portion and a second exhaust gas pipe second end portion, wherein a distance between the first exhaust gas pipe second outer portion and the second exhaust gas pipe second outer portion is greatest at a circumferentially spaced location from the second exhaust pipe first end portion, the second exhaust pipe second end portion, the first exhaust pipe first end portion and the first exhaust pipe second end portion and the distance between the first exhaust gas pipe second outer portion and the second exhaust gas pipe second outer portion is smallest in an area between the second exhaust pipe first end portion and the first exhaust pipe first end portion and in an area between the second exhaust pipe second end portion and the first exhaust pipe second end portion.

18. An exhaust gas duct system in accordance with claim 17, wherein the intermediate space has a contour in a form of a sickle.

* * * * *